United States Patent [19]

Prouty

[11] Patent Number: 5,024,704

[45] Date of Patent: Jun. 18, 1991

[54] METHOD AND APPARATUS FOR CLEANING CAN OPENERS

[76] Inventor: Lee J. Prouty, 176 Athol #8, Oakland, Calif. 94606-1737

[21] Appl. No.: 521,356

[22] Filed: May 9, 1990

[51] Int. Cl.[5] ..... A47L 25/00

[52] U.S. Cl. ..... 134/6; 15/114; 15/160; 15/210 R; 15/244.1; 15/256.5

[58] Field of Search ..... 15/210 R, 246, 160, 15/256.5, 244.1, 114; 134/6

[56] References Cited

U.S. PATENT DOCUMENTS 2,629,124 2/1953 Merritt ..... 15/160 X 2,923,020 2/1960 Fluster ..... 15/210 R

*Primary Examiner*—Edward L. Roberts

[57] ABSTRACT

A can opener cleaner and method of cleaning a can opener are disclosed. The can opener cleaner includes a cylindrical body member with an open top, a top edge and a cylindrical side wall; a lip disposed about the top edge of the body member for retaining the can opener cleaner in engagement with a can opener; a first cleaning element disposed about the top edge for cleaning the inner face of a can opener cutting element; and a second cleaning element disposed within the body member for cleaning the outer face of a can opener cutting element. The first cleaning element is a resilient, fuzzy element, such as a pipe cleaner, attached at three points about the circumference of the top edge of the body member. The second cleaning element is a sponge, and may be provided with a central hole therethrough for storing the can opener cleaner on a hook. The can opener cleaner is mounted to a can opener, and as the can opener is operated the first and second cleaning elements of the can opener cleaner wipe the inner and outer faces, respectively, of the can opener cutting element.

9 Claims, 3 Drawing Sheets

METHOD AND APPARATUS FOR CLEANING CAN OPENERS

TECHNICAL FIELD OF THE INVENTION

The invention relates to a device for cleaning can openers, especially those can openers employing a cutting element for removing the lids from cans.

BACKGROUND OF THE INVENTION

FIG. 1 shows a can opener 10 of the prior art cutting the lid of a can 12. More particularly, the can opener typically comprises a toothed driving wheel 14 and a sharp cutting wheel 16. As shown in FIG. 1, the driving wheel 14 is rotated by a shaft 18 about an axis. In this example, the driving wheel 14 is driven in a anti-clockwise direction, as indicated by the arrow 20. The means for driving the driving wheel 14 is not shown, and typically comprises a hand crank or an electric motor.

The can 12 comprises a cylindrical, metal body portion 22, which is closed at the bottom 24 and open at the top. The can also includes a lid 26 which closes the open top of the body portion 22. As shown in FIG. 1, the lid 26 is formed of a disc-like piece of metal of larger diameter than the body portion 22, and is folded over the top of the body portion to form an annular lip 28 about the top of the body portion 22. A portion 29 of the lid 26 embraces the inner surface of the can wall (body portion) 22, and a central region 30 of the lid 26 is recessed within the top of the body portion 22.

The lip 28 includes a base portion 32 which, when using the can opener, cooperates with and is driven by teeth 34 on the driving wheel 14 to rotate the can with respect to the can opener. The lip 32 of the lid 26 is firmly retained against the teeth 34 of the driving wheel by a downward pressure exerted by the cutting wheel 16. In use, the cutting wheel 16 is introduced in a downward direction, indicated by the arrow 36, onto the lid 26 at the extreme periphery of the recessed region 30. Further downward pressure causes the cutting wheel to pierce (not shown) the lid, generally separating the recessed region 30 from the remainder thereof.

The cutting wheel 16 includes an inner face 38 and an outer face 40, which form a cutting edge 42 about the periphery of the cutting wheel. The cutting wheel 16 is mounted to a shaft 43, and is free to rotate, or is driven, in a clockwise direction, indicated by the arrow 44.

As the driving wheel turns, the can rotates and the cutting wheel rotates and continues to pierce the periphery of the recessed lid region until the recessed lid region separates from the remainder of the lid. The top of the can is thus opened to empty its contents.

It is also known that the cutting element, shown herein as a cutting wheel, can be a non-rotating element. Such a cutting element also pierces the lid of the can and continues to pierce the lid about its periphery as the driving wheel rotates the can with respect thereto.

The contents of the can are generally foodstuffs. Inevitably, some of the can contents adheres to the inner and outer faces 38, 40 of the cutting wheel. Hence, the cutting wheel has been called the "dirtiest square inch" in the kitchen. Prior art techniques of removing latent foodstuff from the cutting wheel include manually scrubbing the cutting wheel with a sponge or a toothbrush. These techniques are fairly adequate for cleaning the outer face 40 of the cutting wheel, but are not satisfactory for cleaning the more difficult to reach inner face 38 of the cutting wheel.

The present invention is applicable to any can opener which is used for removing the entire lid of a can, versus the type of can opener which merely pierces the lid of a can, such as for drinking its fluid contents.

DISCLOSURE OF THE INVENTION

It is therefore an object of the present invention to provide a device and a technique for cleaning a can opener, and primarily for cleaning the cutting element thereof, and especially for cleaning the inner surface of the cutting element.

It is a further object of the present invention to provide a device that is inexpensive to manufacture, works effectively, is intuitive to operate and that can be easily stored in the vicinity of the can opener to encourage its use.

According to the invention, a can opener cleaner is provided having: a cylindrical body member with an open top, a top edge and a cylindrical side wall; a lip disposed about the top edge of the body member for retaining the can opener cleaner in engagement with a can opener; a first cleaning element disposed about the top edge for cleaning the inner face of a can opener cutting element; and, preferably, a second cleaning element disposed within the body member for cleaning the outer face of a can opener cutting element.

According to an aspect of the invention, the first cleaning element is a resilient, fuzzy element, such as a pipe cleaner, attached at three points about the circumference of the top edge of the body member.

According to a further aspect of the invention, the cleaner may also, preferably, have a second cleaning element which is a sponge, which is disposed within the body member, and may be provided with a central hole therethrough for storing the can opener cleaner on a hook.

Both the first and second cleaning elements may be permanently or removably secured to the body member by any suitable means.

Other objects, features and advantages of the invention will become apparent in light of the following description thereof.

Throughout the drawings, various elements have been exaggerated in dimension to facilitate an understanding of the invention.

DETAILED DESCRIPTION OF THE INVENTION

Figure 1:
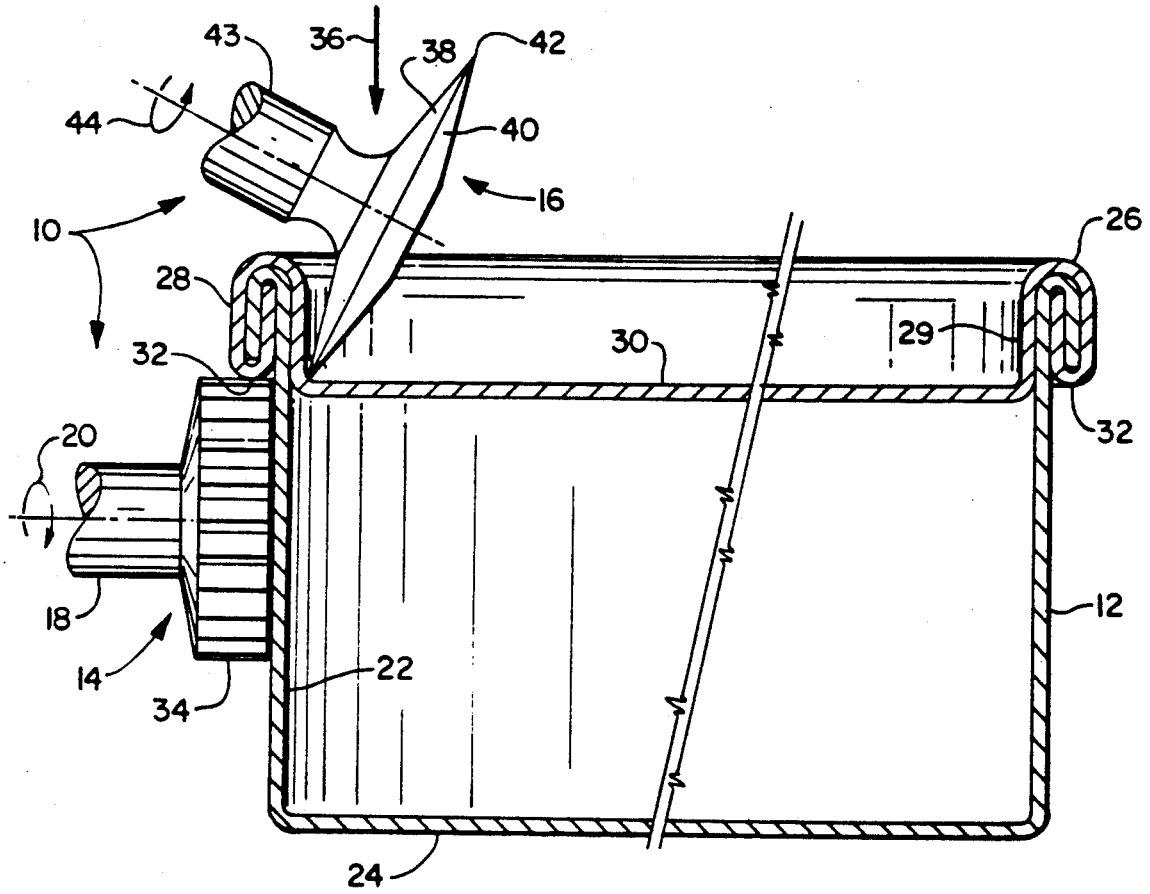
FIG. 1 PRIOR ART
FIG. 1 is a cross-sectional view of a prior art can opener and can.

FIG. 1 has been discussed, and demonstrates the fundamental operation of a can opener opening a can.

The present invention is intended for use with commonplace can openers, such as illustrated in this Figure.

Figure 2:
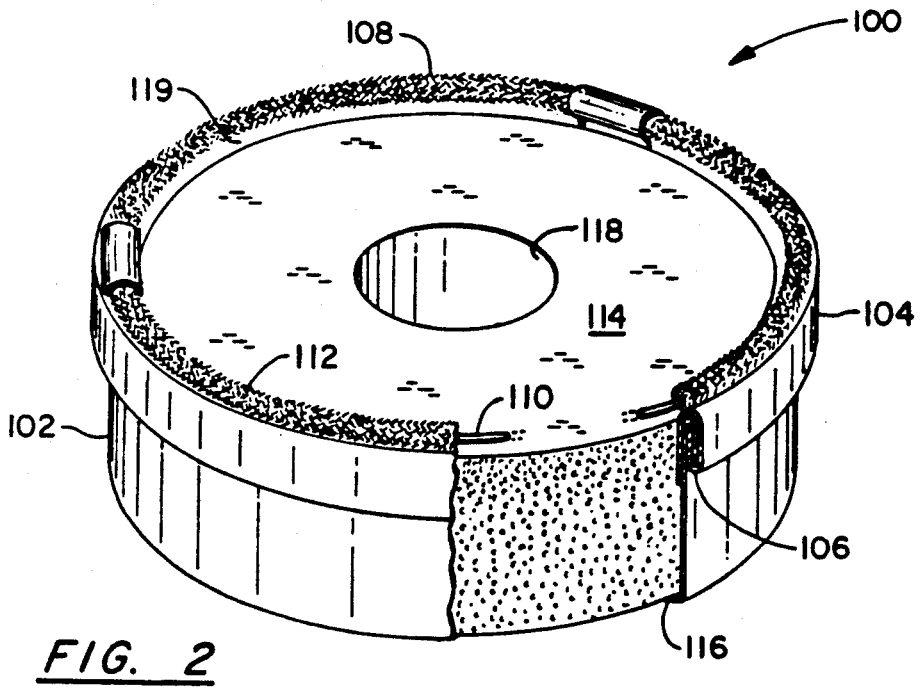
FIG. 2 is a perspective view, partially cutaway, of the can opener cleaner of the present invention.

FIG. 2 shows an embodiment of the can opener cleaner 100 of the present invention. Generally, the can opener cleaner 100 comprises a cylindrical body member 102 open at its top end (as viewed in the Figure). A lip 104 is formed about the external periphery of its open top end and has base portion 106 corresponding to the base portion 32 of the lip 28 of FIG. 1.

The exterior appearance of the can opener cleaner 100 bears a striking resemblance to the can 12 and lid 26 of FIG. 1, and this resemblance is intentional. As will be evident hereinafter, it is intended that the can opener cleaner 100 be used in connection with a can opener (e.g., the can opener 10 of FIG. 1) to clean the inner and outer faces of the cutting element thereof (e.g., the cutting wheel 16 shown in FIG. 1). In fact, it will become evident that the body member 102 and lip 104 of the can opener cleaner are suitably formed from the upper portion of a can.

A first cleaning element 108 is disposed about the top edge of the body member 102, and includes a relatively rigid, circular support member 110, such as a wire, which supports a plurality of relatively resilient, "fuzzy"fibers 112. An example of such a cleaning element 108 is a pipe cleaner. The first cleaning element 108 is intended for cleaning the inner surface of a can opener cutting element, as described in greater detail hereinafter. The first cleaning element is attached to the top edge of the body member 102 in a manner described in greater detail hereinafter.

A second cleaning element 114 is disposed interior the body member 102, and is suitably a disc-shaped sponge which extends to the (cylindrical) side walls of the body member 102 and to the top edge thereof. It should be understood that the side walls of the body member 102 need not be perfectly cylindrical, but may form an oval or rounded rectangular opening, or the like.

The second cleaning element 114 is intended for cleaning the outer surface of a can opener cutting element, as described in greater detail hereinafter. The second cleaning element is removably retained within the body member generally by an interference fit, its outer diameter being slightly greater than the inner diameter of the body member, and is further retained within the body member by an annular lip 116 extending about the inner periphery of the bottom edge of the body member 102. The second cleaning element 114 is suitably formed of an ordinary high density or low density sponge, and may be provided with a hole 118 through it s center for hanging the can opener cleaner 100 from a hook (not shown) which is suitably located in the vicinity of the can opener, which will encourage the use of the can opener cleaner.

A gap 119 is shown between the first and second cleaning elements to indicate that this is where the cutting element of the can opener will ultimately reside during cleaning. However, it should be understood that the second cleaning element 114 preferably extends to the inner surface of the body member 102, and is resiliently deflected by the cutting element.

Simply stated, the can opener cleaner mechanically emulates the top portion of a can, insofar as it is retained and rotated by a can opener in a similar manner to a can. When the can opener cleaner is so retained and rotated by a can opener, successive circumferential portions of the first and second cleaning elements come into wiping contact with the inner and outer surfaces of the can opener cutting element, cleaning same. After cleaning, the can opener cleaner is easily cleaned in soapy water for further use.

Figure 3:
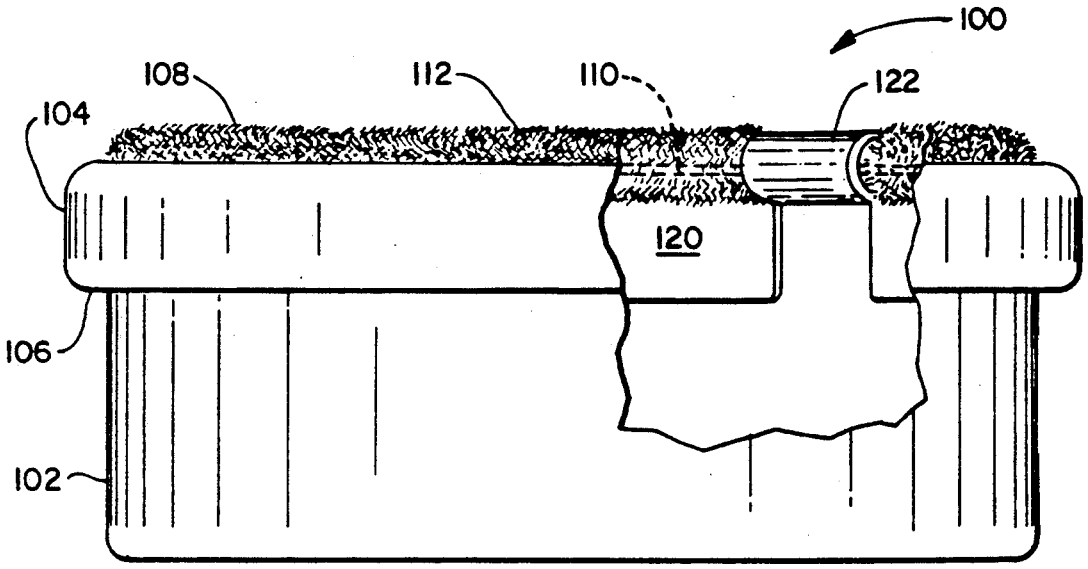
FIG. 3 is a side view, partially cutaway, of the can opener cleaner of the present invention.

FIG. 3 shows a cross section of the can opener cleaner 100 of FIG. 2, with the second cleaning element (sponge) removed for clarity. The bottom lip 116 is not visible in this view.

As mentioned hereinbefore, the lip element 104 extends about the periphery of the top edge of the body member, and emulates the lip (28 of FIG. 1) of a can for the purpose of retaining and rotating the can opener cleaner 100 in a can opener. The lip element 104 is suitably formed from the portion of a can lid (e.g., 26 of FIG. 1) remaining after the recessed portion (e.g., 30 of FIG. 1) has been excised, and includes a portion 120 extending down the interior wall of the body member 102 from the top edge thereof (compare 29 in FIG. 1).

Figure 4:
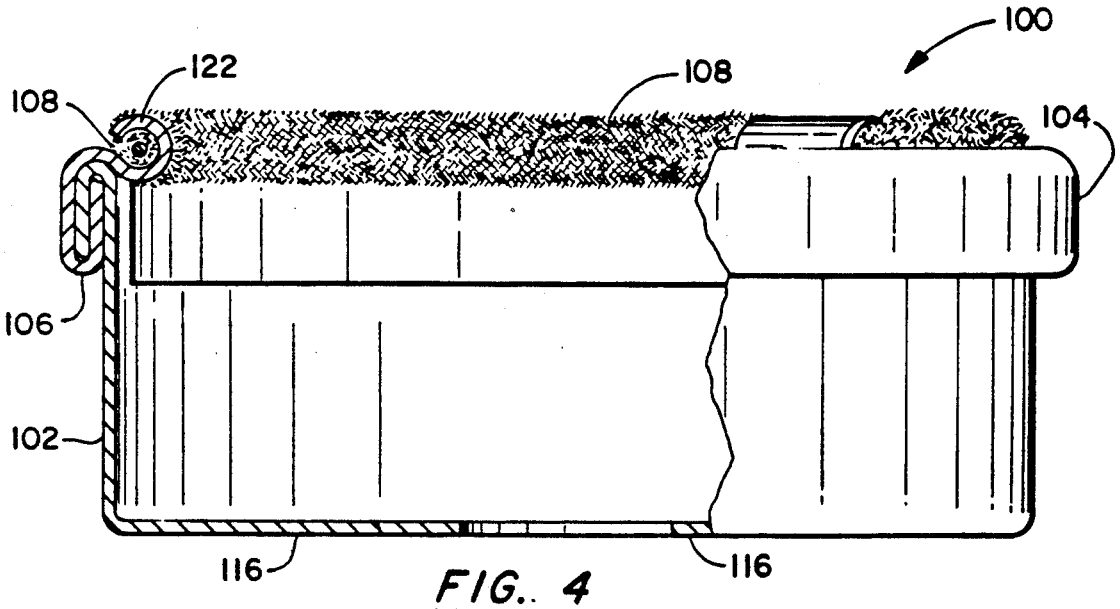
FIG. 4 is a side cross-sectional view of the can opener cleaner of the present invention.

With reference to FIGS. 3 and 4, a suitable arrangement for retaining the first cleaning element 108 atop the top edge of the body member 102 is illustrated. A number of flanges 122 (one shown) are disposed about the inner circumference of the body member 102, and curve upwardly about the inner circumference and top surface of the first cleaning element 108 to retain the first cleaning element 108 atop the top edge of the body member. Preferably, three flanges 122 are provided at equally-spaced intervals (every 120 degrees) about the inner circumference of the body member 102 at the top opening thereof to establish a plane in which the first cleaning element 108 is retained normal to the cylindrical axis of the body member. Suitably, each of the flanges has a circumferential extent of approximately 10–45 degrees.

In addition to retaining the first cleaning element atop the body member, the flanges 122 provide locations whereat the can opener cleaner is most conveniently installed on the can opener. This is attributable to the fact that the flange 122 "shields", or encases the first cleaning element, making it easier for the cutting element (e.g., 16 of FIG. 1) to be positioned within the body member 102 in contact with the cylindrical wall thereof. It is noticeably somewhat more difficult to position the cutting element when the exposed portions of the first cleaning element are aligned therewith.

Figure 5:
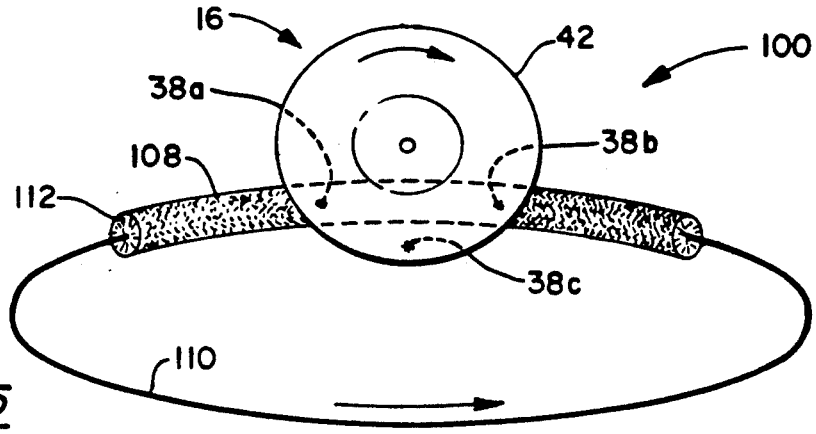
FIG. 5 is a schematic, perspective view detailing cleaning the inner face of a can opener cutting wheel with the can opener cleaner of the present invention.

FIG. 5 illustrates the cleaning action by the first cleaning element 108 with respect to the inner face (38, hidden) of a cutting wheel 16. In this view, the fuzzy part 112 of the cleaning element 108 is shown partially stripped away from the support member 110.

As the first cleaning element 108 rotates with respect to the cutting wheel 16 (as the can opener cleaner is rotated by the can opener driving wheel, not shown), the cutting wheel is also rotating. Notably, the cutting wheel is rotating in one axis, and the first cleaning element is rotating in another, orthogonal axis. Inasmuch as the first cleaning element is circular, and "wraps around" a lower portion of the essentially flat cutting wheel, the first cleaning element contacts the inner surface of the cutting wheel at two chordwise opposite points **38*a*, 38*b* about its periphery. These points 38*a*, 38*b* are typically located at a radius of about r/2 from the axis of the cutting wheel. The fuzzy part 112 of the first cleaning element 108 will preferably contact the inner surface of the cutting wheel between the points 38*a* and 38*b*. Since the cutting wheel is also rotating, and since it is much smaller in diameter than the first cleaning element, the cutting wheel will rotate several times for one full rotation of the first cleaning element 108. In this manner, at least the entire periphery of the inner face of the cutting wheel, and preferably the entire inner face of the cutting wheel, is "wiped" by the first cleaning element 108**.

The outer face of the cutting wheel is similarly "wiped" clean by contact with the second cleaning element 114. Preferably, both the inner and outer faces of the cutting wheel are wiped clean simultaneously during the described cleaning process.

Further, when the cutting wheel is disengaged (i.e., lifted upward to release the can opener cleaner from engagement with the can opener), the extreme lower portion 38c of the inner face of the cutting wheel will wipe against the first cleaning element.

Thus, the can opener cleaner of the present invention provides a technique for cleaning the inner and outer faces of the cutting element (e.g., cutting wheel) of a can opener. The device is inexpensive to manufacture, and is intuitive to operate inasmuch as it physically resembles the top of a (opened) can.

Figure 6:
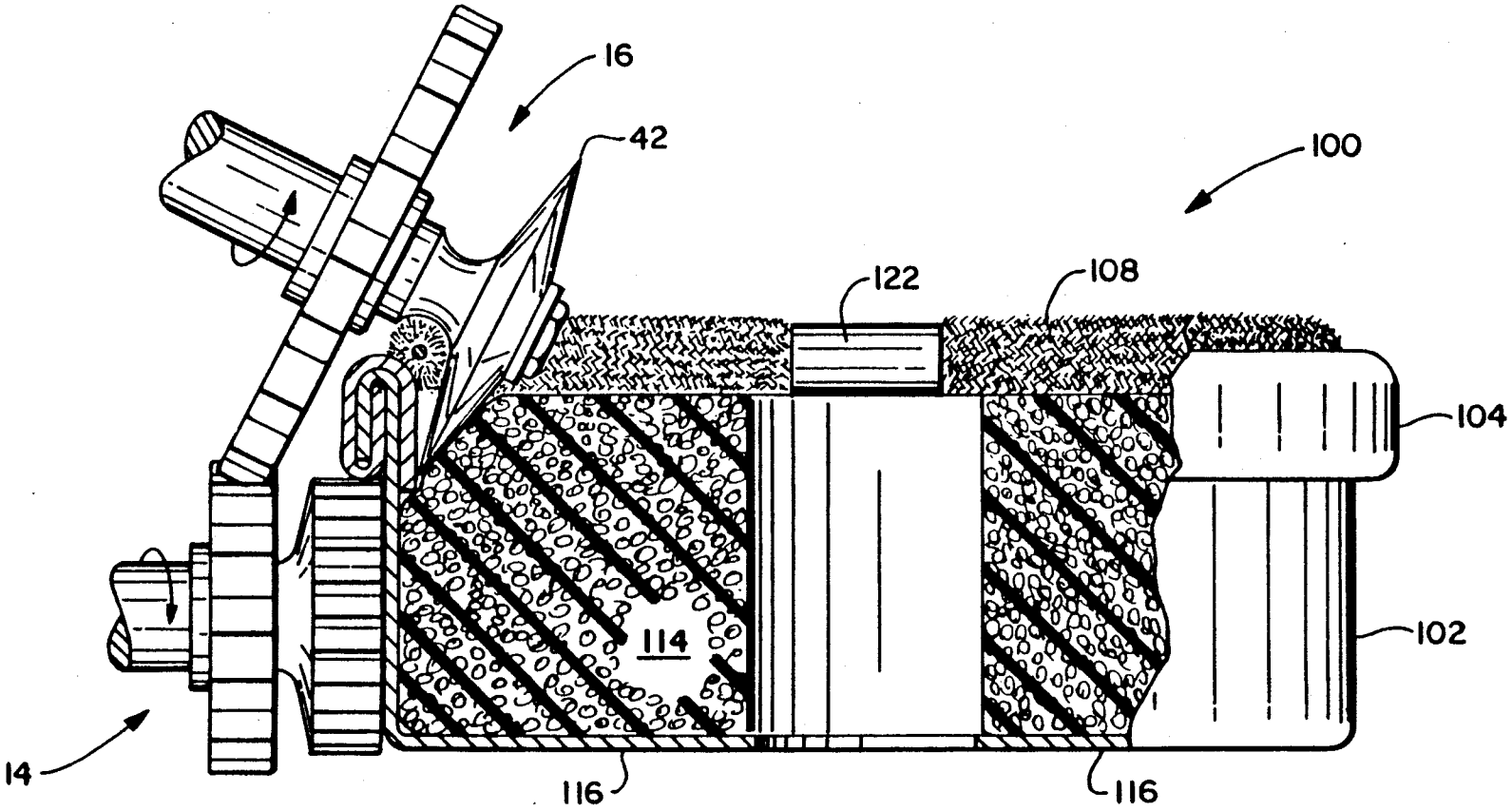
FIG. 6 is a cross-sectional view of the can opener cleaner of the present invention in use.

FIG. 6 shows the can opener cleaner 100 of the present invention retained by the driving wheel 14 and cutting wheel 16 of a can opener.

I claim:

1. A can opener cleaner comprising:

a cylindrical body member having a cylindrical side wall, an open top and a top edge;

means for retaining the body member between a driving wheel and a cutting element of a can opener; and first cleaning means disposed on the top edge of the body member for wiping an inner face of the cutting element.

2. A can opener cleaner according to claim 1, further comprising:

second cleaning means disposed within the body member for wiping an outer face of the cutting element.

3. A can opener cleaner according to claim 1, wherein:

the means for retaining the body member is a lip disposed externally about the top edge of the body member.

4. A can opener cleaner according to claim 1, wherein:

the first cleaning means comprises a wire support member and a plurality of fuzzy, resilient fibers.

5. A can opener cleaner according to claim 1, wherein:

the second cleaning means comprises a sponge.

6. A can opener cleaner according to claim 1, wherein:

the body member is formed of a top portion of a can, including a lip portion of a lid of the can.

7. A can opener cleaner according to claim 1, wherein:

the cutting element is a cutting wheel.

8. A method of cleaning a can opener having a driving wheel and a cutting element, the cutting element having inner and outer surfaces, comprising:

inserting a can opener cleaner having a first cleaning element between the driving wheel and the cutting element of the can opener;

rotating the driving wheel to rotate the can opener cleaner so that the inner surface of the cutting element is wiped clean by the first cleaning element of the can opener cleaner.

9. A method according to claim 8, wherein:

the can opener cleaner has a second cleaning element contacting the outer surface of the cutting element ; and rotating the driving wheel causes the second cleaning element to wipe clean the outer surface of the cutting element.

* * * * *